United States Patent [19]

Bricaud et al.

[11] Patent Number: 4,637,306

[45] Date of Patent: Jan. 20, 1987

[54] BUCKETS FOR COMPACTABLE PRODUCTS

[76] Inventors: Jean-Paul Bricaud, 95 Rue du Stade-La Chabossière, 44220 Coueron; Martine Bricaud, 6 Rue Yves-Marie, 44000 Nantes, both of France

[21] Appl. No.: 734,591

[22] Filed: May 16, 1985

[30] Foreign Application Priority Data

May 23, 1984 [FR] France ..... 84 08055
Jan. 24, 1985 [FR] France ..... 85 00974

[51] Int. Cl.[4] ..... B30B 7/00

[52] U.S. Cl. ..... 100/233; 100/295; 414/525 R

[58] Field of Search ..... 100/233, 295; 414/525 R

[56] References Cited

U.S. PATENT DOCUMENTS 3,901,394 8/1975 Bowles .
3,903,461 9/1975 Waggoner .
3,942,430 3/1976 Day ..... 100/233 X
4,128,054 12/1978 Chenot ..... 100/233

FOREIGN PATENT DOCUMENTS 2300636 7/1974 Fed. Rep. of Germany ... 414/525 R
3332412 3/1984 Fed. Rep. of Germany .
424019 5/1911 France .
1545840 12/1968 France .
2189280 1/1974 France .
2190090 1/1974 France .
2215312 8/1974 France .
2249817 5/1975 France .
2293306 7/1976 France .
2362778 3/1978 France .
2421820 11/1979 France .
1456436 11/1976 United Kingdom ..... 100/233
1539710 1/1979 United Kingdom ..... 100/233

*Primary Examiner*—Billy J. Wilhite
*Attorney, Agent, or Firm*—Young & Thompson

[57] ABSTRACT

The present invention relates to a bucket for compactable products comprising a compaction member mobile in rotation about an axis rigidly connected to the bucket bottom and situated in the lower portion of the compaction member. According to the invention, the compaction member has a shape such that it bears against at least a portion of the wall of the bucket substantially parallel to one direction and is articulated at its other end about an axis situated in the bucket bottom, off-set toward the center of the bucket and substantially parallel to that one direction, its upper end comprising at least a coupling with a pulling and/or pushing member possibly independent of the bucket. The invention is applicable to buckets, notably so-called "multi-buckets", in order to increase their transportation capacity in the case of compactable products.

4 Claims, 17 Drawing Figures

BUCKETS FOR COMPACTABLE PRODUCTS

FIELD OF INVENTION

The present invention relates to buckets used for the transportation of compactable products such as organic materials, household refuse, turning chips and others, and more particularly buckets or containers which can be alternately used for the temporary storage and transportation of the most various products, notably according to the so-called "multi-bucket" system.

BACKGROUND OF PRIOR ART

It is a common practice to provide the buckets specialized in the transportation of compactable products, notably the buckets used for the removal of garbage, with a compacting mechanism comprising a mobile wall inside the loading volume, the motion of said mobile wall being controlled by a powerful prime mover member of its own, notably a system of hydraulic jacks. Such buckets for compactable refuse are described for example in French Pat. Nos. 1,189,280; 2,215,312 or 2,293,306. Such buckets have a specific usage and the compaction device which has to be permanently mounted fills a large volume and has a significant weight, thereby reducing in proportion the loading capacity of the vehicle on which is mounted the bucket and the compaction device.

In French Pat. Nos. 1,545,840; 2,421,820 and 2,362,778 have also been proposed containers or boxes including compressing devices. In French Pat. No. 2,362,778 notably, said compressing device is made of a mobile wall which is articulated about an axis situated in the bottom of the caisson and which cooperates in a tight manner with the side faces of said caisson and an upper cylindrical wall centered on the axis, the displacements of the plate and its setting under pressure being controlled by a difference of the pressures prevailing on its two faces. The devices described in said patents occupy a large portion of the volume of the container and require specific driving motors. Moreover, their weight adds up to the dead weight of the bucket or container when the bucket or container is used for the storage and transportation of non compactable materials.

U.S. Pat. No. 3,903,461 discloses a bucket for compactable products comprising a compaction member rotatably mobile about an axis rigidly connected to the bottom of the bucket and situated in the lower portion of the compaction member, said compaction member having a shape such that it bears against at least one portion of a wall of the bucket which is substantially parallel to one direction and is articulated at its lower end about an axis situated in the bottom of the bucket and substantially parallel to said one direction. In said bucket however, the articulation axis of the compaction member is situated in the bottom of the bucket, at the foot of the wall against which comes to bear the compaction member which, therefore, has a reduced angular stroke and which presses the products against the bottom of the bucket in the vicinity of the articulation axis while a logical compression should drive the products back against the other end wall of the bucket and press them essentially against said wall.

OBJECTS AND SUMMARY OF INVENTION

The object of the present invention is to remedy these disadvantages and provide a compaction device for a bucket which is simple, does not reduce substantially the useful volume of the bucket, does not require its own driving motor, the compression action of which is high at any filling stage of the bucket, and which can be easily disassembled from the bucket when said bucket is used for non compactable materials.

According to the invention, this object is accomplished by the improvement according to which the compaction member has a shape such that it applies against at least a portion of a bucket wall which is substantially parallel to one direction, is articulated at its lower end about an axis situated at the bottom of the bucket and substantially parallel to said one direction, the bucket for compactable products being characterized in that said articulation axis of the compaction member is off-set toward the center of the bucket and in that the upper end of the compaction member includes at least one coupling means with a traction and/or pushing member, possibly independent from the bucket.

Due to the shape of the compaction member, its presence reduces to a minimum the useful volume of the bucket. The articulation axis of the compaction member situated in the bottom of the bucket being off-set toward the center of said bucket, the compacting operation includes a lifting and transportation of the material toward the opposite bucket end, thereby increasing the volume made free for loading a new volume of material, and improves the compaction action, the displacement component along the bucket length or the compacting direction being greater than when it has an articulation in the plane of a compacting planar wall. Finally, due to the coupling means, the compacting force can be provided by motors independent from the bucket, for example the power-take-off of a tractor, the traction force of a truck or of a self-propelled vehicle, a winch, etc. However, the scope of the invention includes also the provision of a pushing or pulling means acting between the compaction member and the bucket itself, such as one or several screw or hydraulic jacks which can be driven by the power-take-off of a tractor or fed from the hydraulic circuit of a separate machine, the pushing or pulling means being preferably removable.

Preferably and according to another feature, the articulation axis situated at the lower end of the compaction member is dismountable so as to make the compaction member removable. This allows disassembling the compaction member from the bucket when said bucket is used for non compactable products.

According to another feature, the articulation axis of the compaction member is mobile along the longitudinal direction of the bucket. The displacement of the articulation axis can be performed by a device which does not produce a compacting power, or by a device taking part in the compaction operation. By way of example, the hub of the articulation axis can be made displaceable by a worm gear. Such a feature allows, at the beginning of the loading operation, to bring the compaction device close to the opposite end of the bucket and to limit the volume of compacted material during the first operations, thereby providing a more efficient and homogeneous compaction.

According to a particular embodiment, the compaction device is formed of a portion of the wall and a portion of the bottom of the bucket which are rigidly connected and articulated about the other portion of the bucket bottom via the articulation axis of the compaction device.

Preferably, the coupling means of the compaction device is carried by a rigid prolongation element rigidly attached and preferably in a removable manner, or a retractable manner, on the compaction device in order to be able to move the coupling means away from the articulation axis and to increase the lever arm.

According to another feature and when the compaction device occupies only a fraction of the bucket width, the articulation in the bottom of the bucket allows a tipping motion about the axis perpendicular to the articulation axis. In that case, the shape of the compaction member can be such that it fits, in the two extreme inclined positions, against the lateral bucket sides. It can also include flaps articulated onto the main compaction member in order to provide a volume generated by the surface of the compaction member in its various inclinations, which occupies the whole of the bucket section. This embodiment of the compaction device allows increasing the compacting specific pressure. The same result is obtainable by subdividing the compaction member into a plurality of juxtaposed elements. In the case of a material likely to flow around the edges of the compacting element and when said element is subdivided into several juxtaposed elements, it is possible to provide skirts closing the intervals between the elements, the element positively displaced causing, after a displacement corresponding to the skirt width, the entrainment of the adjacent elements. Due to the transmission angle of the forces in the compacted mass, a skirt having a relatively small width and imparting a small delay to the entrained elements allows concentrating the compacting force on the positively displaced element.

The coupling means can be of any type adapted to the device providing the pushing or pulling force. The coupling means can be dismountable should it be likely to interfere with the device for the loading of the filled bucket. By way of examples of such a coupling means, one can mention a sleeve with a ball coupling into which can engage the boom of a lifting machine exerting a pushing action, the fork of a lift-truck or the stem of a hydraulic jack, an eyelet for the engagement of the hook of a winch cable with possibly cable guiding means, pulling or pushing scissors which can possibly form a manual jack or a jack driven by the power-take-off of a tractor of via a hydraulic jack. The coupling means can comprise a force or torque limiting device for avoiding the breaking of mechanical parts when hard points exist in the compacted mass.

With a view to increasing the compacting force exerted by the compaction member and to possibly make the compaction device removable from the bucket, the coupling means with the pulling and/or pushing member can be formed of an arm articulated at one of its ends to the bucket about an axis parallel to the articulation axis of the compaction member, and carrying at its other end a roller rotatably mounted about an axis parallel to the two others, the point of action of the pulling and/or pushing member on the arm being situated above the articulation point of said arm on the bucket and between said articulation axis on the bucket and the roller rotation axis.

According to another feature, the coupling means between the compaction arm and the pulling and/or pushing member is made of a knuckle joint device, the two tie-rods on either side of the knuckle joint device being directly or indirectly articulated onto a point of the compaction arm on the one hand, and on a point fixed with respect to the bucket on the other hand, and the pulling and/or pushing member acting on the knuckle joint in order to draw the two articulation points apart by bringing the knuckle joint closer to the line connecting said two points.

According to another feature, the knuckle joint device is combined with a coupling means comprising a lever arm with a roller, the knuckle joint device acting only after a first compression stroke provided by the coupling means comprising a lever arm with a roller.

According to an embodiment, the knuckle joint device comprises an arm in the shape of a tie-rod articulated on the bucket about a fixed axis parallel to that of the compaction arm, a second arm articulated at the free end of said first arm by the knuckle joint, a prime mover means acting onto one of the two arms, preferably in the vicinity of the articulation point forming a knuckle joint, in order to increase the angle encompassed by said two arms, the end of the second arm being articulated onto the compaction arm. According to a preferred embodiment, the end of the second arm is articulated on the compaction arm via a tie-rod articulated at one end on said compaction arm and at its other end to the end of said second arm, the rotation of said tie-rod in the direction resulting from the thrust exerted by the second arm during the increase of the angle formed between the two first arms being limited by an abutment rigidly connected to the compaction arm and the articulation point between the second arm and the tie-rod being pushed, at the end of the stroke, toward the line joining the articulation points of the two other ends due the second arm coming in engagement against an abutment rigidly connected to the compaction arm.

According to another feature, the prime mover means which drives the stepping down device is made of the arm with a roller. In this case, the displacement of the arm with a roller is preferably transmitted to the knuckle joint device by a connection tie-rod articulated on the articulation axis which forms the knuckle joint. The dead stroke device is accomplished by a delay in the rigid connection established between the connection tie-rod and the arm with a roller in the initial rotation stroke of said arm with a roller.

According to another feature, the return motion of the arm with a roller is positively transmitted to the knuckle joint device in order the provide the retraction of the latter.

According to another feature and particularly in the case of a parallelepipedal bucket with a removable rear wall, or formed with opening doors or a tipping pannel, the compaction device is independent of the bucket and removable, articulated in a tipping manner on a transverse axis at the rear of the bucket, and it comprises, in combination, a caisson and a compaction arm articulated in the vicinity of one of the caisson edges.

The compaction device can also be used in combination with a vat in order to provide a crushing device for many products such as wooden or cardboard boxes, pallets, glass articles, etc., and notably for providing a roughing down crusher upstream of the standard crushers.

BRIEF DESCRIPTION OF DRAWINGS

Other features of the present invention will become more apparent from the reading of the hereafter detailed description of various emodiments, with reference to the schematic accompanying drawings wherein.

DETAILED DESCRIPTION OF INVENTION

Figure 1:
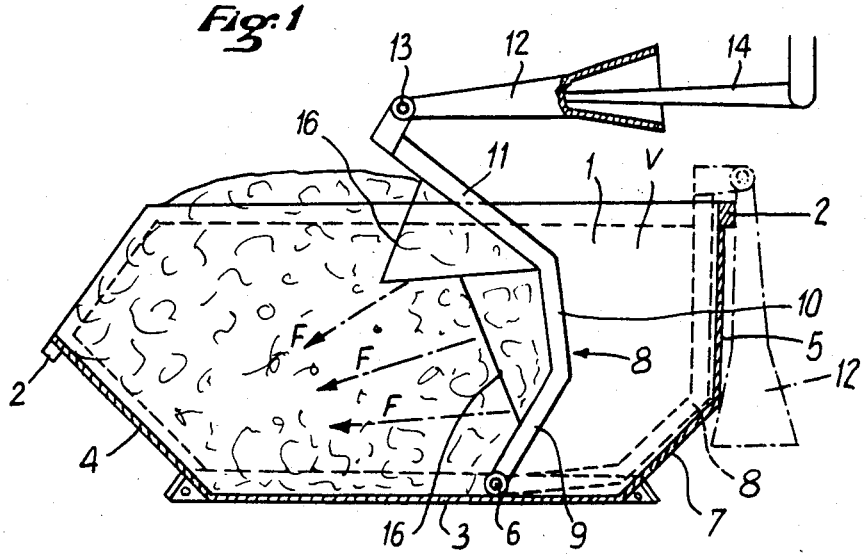
FIG. 1 is a longitudinal sectional view of a bucket, for explaining the principle of the invention.

In the drawings, reference 1 designates the bucket as a whole and the side vertical walls of said bucket, reference 2 the reinforcement ribs, reference 3 the bottom metallic plate of the bucket, reference 4 the end wall of the bucket in the direction of which is made the compaction operation and reference 5 the opposite transverse wall against which the compaction member takes its bearing.

According to the invention, the compaction device is articulated about an axis 6 parallel to wall 5 and situated in the vicinity of the bottom 3 while being off-set toward wall 4 with respect to wall 5. In this type of bucket and notably in the so-called "multi-buckets" which are to be loaded on a platform, wall 5 is vertical and connected to bottom 3 by a cant-wall 7. The compaction device 8 is therefore formed of three sections rigidly connected, one of which 9 is adapted to come to bear against bottom 3, the other 10 to come in engagement with the cant-wall 7 and the third 11 to come against vertical wall 5. Coupling member 12 is articulated at the end of section 11. In this embodiment of FIG. 1, the coupling member is a conical sleeve articulated at 13 and allowing the thrust which causes the compaction together with fork 14 of a fork-lift.

At rest and as shown in dotted lines, the compaction device is applied against wall 5 and the coupling sleeve 12 hangs outside the bucket. When the bucket is filled with non compactable material, it is possible with a fork-lift to engage fork 14 of said fork-lift inside the opening of sleeve 12 in order to bring it to the horizontal, and then to exert a thrust for bringing the compaction member 8 to the position shown in full lines. The compaction is carried out in the direction of arrows F shown in chain-dot lines and, when the compaction member 8 is brought back to its rest position, a V-shaped empty space is made free, in which an extra mass of compactable material can be loaded and then also compacted.

The front face of compaction member 8 which can be of any construction and made of solid or punched sheet metal, or of bars, is provided with ridges 16 which can concentrate the pressure on crushable hard elements such as wooden boxes or similar, in order to crush them.

In the other Figures, the same numeral references are used for designating the same elements as in FIG. 1, or equivalent elements.

Figure 2:
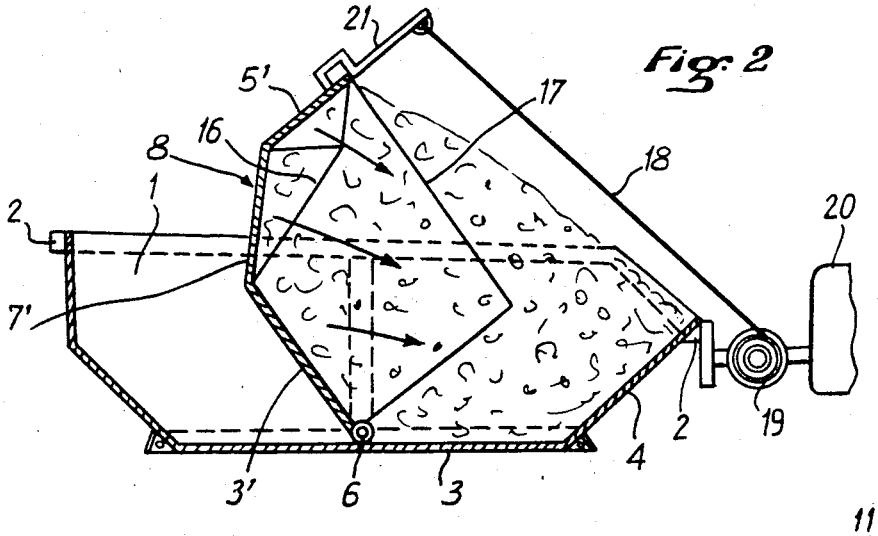
FIG. 2 is a similar view of another embodiment.

In the embodiment of FIG. 2, the compaction member 8 is made of the portions 5', 7' and 3' forming the wall 5 and the cant-wall 7 of the bucket as well as a sheet metal lining the bottom 3 up to the level of axis 6. The compaction member is completed by side walls 17 which bear against walls 1 and can slide against said walls. The ridges 16 are supported on the mobile walls 5'–7' which form the compaction member. This embodiment allows reducing the dead weight of the bucket with respect to the embodiment of FIG. 1, but the compaction member cannot be removable, so that this embodiment is prefered for the case where the bucket is specifically used for compactable products.

In this embodiment, the compaction operation is performed by using the pulling force of cable 18 of a winch 19 of a truck 20 which comes to bear by its bumper against face 4 of the bucket. In order to increase the lever arm, a prolongating element 21 which can be telescopic is fixed in a removable manner on the upper edge of the compaction member 8, said prolongating member presenting the eyelet in which engages the hook of cable 18.

Figure 3:
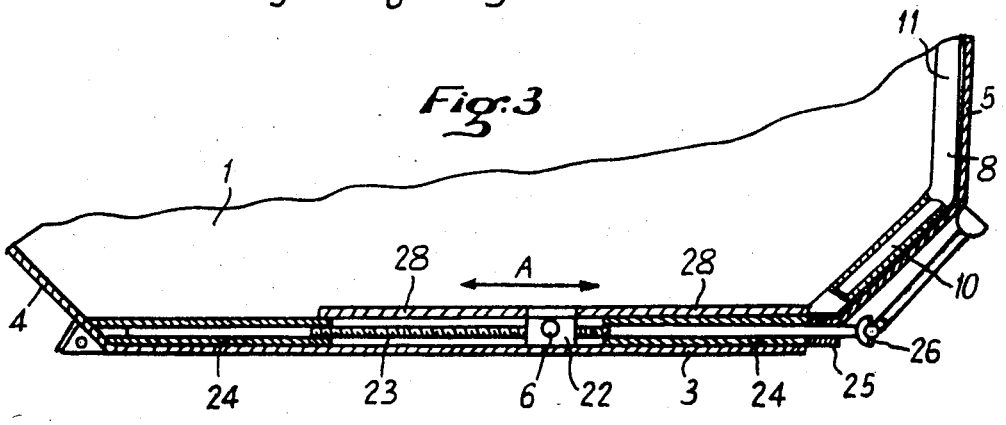
FIG. 3 is a partial view illustrating a device for making the compaction device mobile along the compaction direction.

In the embodiment of FIG. 3, axis 6 is carried by a block 22 in the threaded bore of which is screwed a threaded rod 23 which is rotatably mounted at its smooth ends in the two supports 24 welded on the bottom sheet metal 3. An end of the threaded rod 23 extends outside the bucket through a bearing 25 and is rigidly connected in rotation by a cardan joint 26 to a prolongating element 27 which can be connected to the power-take-off of the tractor. The compaction member 8, the tipping of which can effect the compaction, can be controlled in any manner and moreover can be subjected to a translation motion in one or the other direction of arrow A. Sheathes 28 which slide on the supports 24 protect the threaded screw 23 from being crushed by the compacted material. The displacement of the compaction member in the direction of arrow A can determine the first compression of the material and also bring the compaction member nearer wall 4 in order to obtain a homogeneous compaction.

Figure 4:
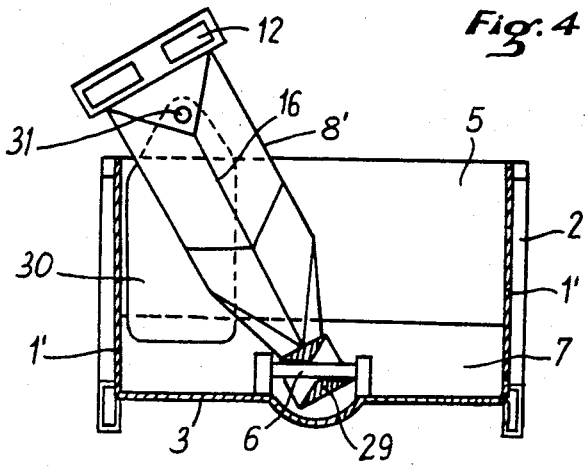
FIG. 4 is a transverse sectional view of the compaction device mounted so as to oscillate perpendicularly to the compacting direction.

In the embodiment of FIG. 4, the compaction member 8' is of reduced width as compared to the total width of the bucket and is fixed on axis 6 limited to the central portion of the bucket by a double cone bearing 29 allowing to slant sideways the compaction member in order to compact alternately the mass of material which is in the right hand and left hand portions or in the central portion of the bucket. For providing the compaction of the material which is in the lower portion close to wall 1', a plate 30 is articulated at 31 in the axis of member 8 and hangs freely along wall 1' in order to sweep said volume of material.

Figure 5:
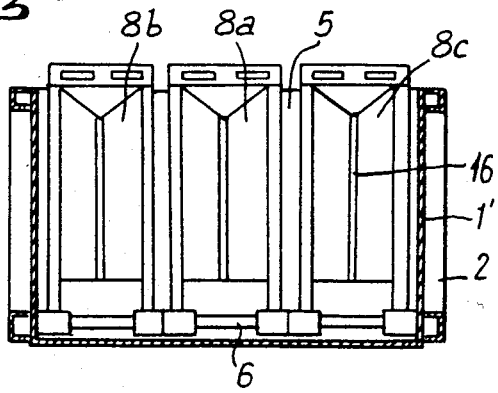
FIG. 5 illustrates still another embodiment of the compaction device.

In the embodiment of FIG. 5, the compaction member is subdivided into three portions 8*a*, 8*b* and 8*c*, said three portions being articulated at their base about axis 6.

This arrangement allows, as for the embodiment of FIG. 4, compacting the material in longitudinal slices and therefore using a less powerful apparatus and, moreover, to prevent the material from passing around the compaction member if the whole mass exhibits some flow capacity. If such a motion round the member is particularly feared, two elements in contact such as 8*a*, 8*b* can have side flanges, possibly with lamellae arranged as a fan, maintaining the continuity of the wall during the tipping motion toward the front of the next element.

Figure 6:
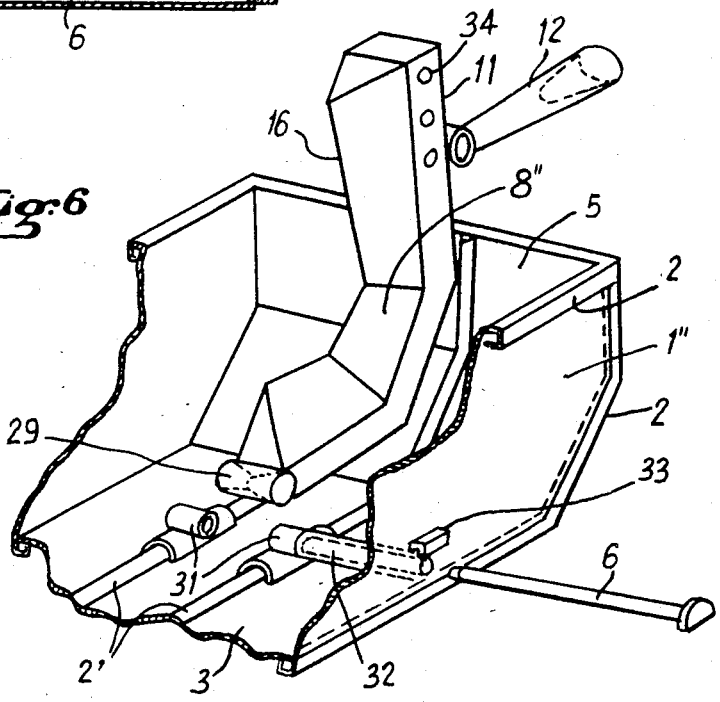
FIG. 6 is a perspective view illustrating a removable mounting mode of the compaction member.

In FIG. 6 is shown an alternative embodiment of compaction member 8" of FIG. 4, in which the compaction member is removable. Axis 6 is slidably mounted in supports 31 welded on bottom 3 and in a tube 32 connecting one of supports 31 to the adjacent wall 1'. Axis 6 comprises means 33 for blocking it in position. In this embodiment, the connection member 12 is rigidly connected to the portion 11 of the compaction member by an axis, not shown, which can engage in one of a plurality of supports 34 in order to modify the lever arm and the stroke. This allows removing the connecting member 12 after the compaction so that it does not interfere with the loading operation of the bucket. It is also possible to construct portion 11 of compaction member 8" in a telescopic fashion.

According to an alternative embodiment, supports 31 are welded on a sub-frame formed for example by beams such as 2' and braces not shown, which fits into the bucket, axis 6 only passing between said supports. In this alternative embodiment, the whole of the compaction device is independent of the bucket.

Figure 7:
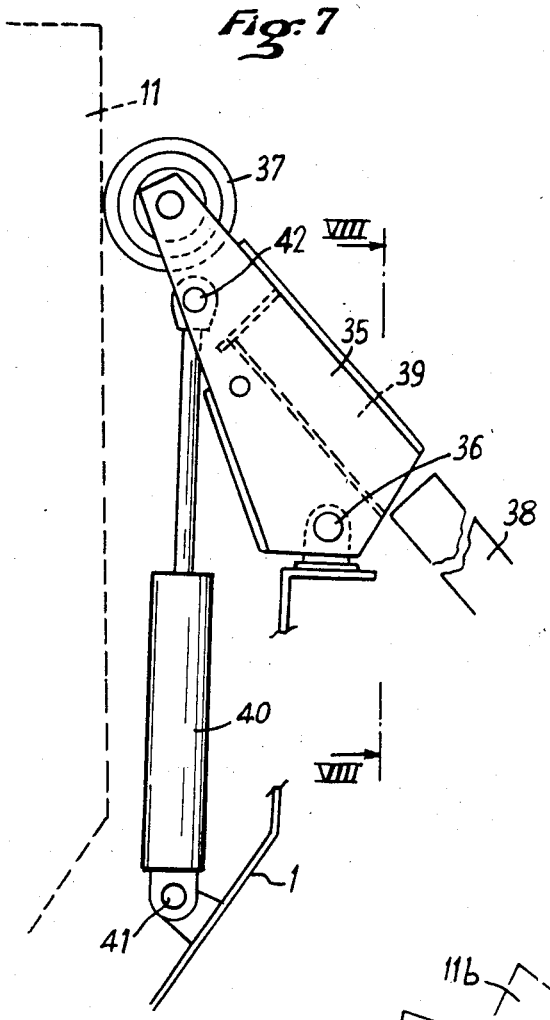
FIG. 7 is a side elevation view of an embodiment of the coupling means having a lever with a roller.
Figure 8:
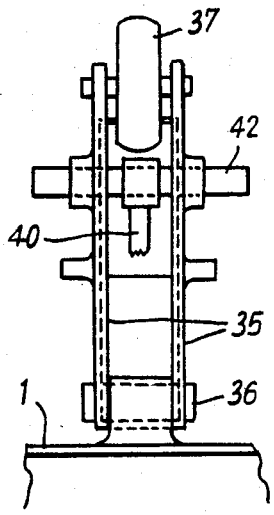
FIG. 8 is a sectional view along line VIII—VIII of FIG. 7.

In the embodiment shown in FIGS. 7 and 8, an arm 35 is rotatably mounted about an axis 36 at the top of wall 1 of the bucket, situated behind the compaction arm. At its opposite end, said arm carries a roller 37 coming in engagement with the rear face of arm 11. The rotation of arm 35 about its axis 36 exerts a thrust via roller 37, said thrust increasing until the line joining axis 36 with the axis of roller 37 is perpendicular to the rear face of arm 11. The torque causing the rotation of the arm can be exerted by the fork of a lift-truck 38 engaged in a housing 39 provided to this effect in the arm, or by means of a jack 40 acting between an axis 41 carried by bucket 1 and an axis 42 rigidly connected to the arm.

Such a coupling means between the pulling and/or pushing member and the compaction arm has proved efficient for avoiding the dead point at the beginning of the compaction motion, but its stroke is too limited.

In the device shown as an example in FIGS. 9 through 13, the same elements as in FIGS. 7 and 8 are designated by the same references. For prolongating the action of arm 35 supporting a roller, said arm is equipped with a stepping down device with tie-rods, controlled by the rotation of arm 35.

The tie-rods of the stepping down device can be assembled in a forked assembly. Said device comprises a first tie-rod 43 articulated at 44 on a fixed point rigidly connected to the wall of bucket 1, axis 44 being close to axis 36. At its other end, tie-rod 44 is articulated at 45 on a second tie-rod 46 which is in turn articulated at 47 to a third tie-rod 48 articulated at 49 to the compaction arm. About axis 45 is articulated a third tie-rod 50 articulated at its other end at 51 to a tie-rod 52 articulated at 53 to the arm 35. Articulation axis 42 of the jack extends beyond the two lateral faces of arm 35, as shown in FIG. 8, and comes to bear, during the rotation of arm 35, against the tie-rods 43, 50, 52 of the forked assembly in order to entrain the tie-rod system as described hereafter.

The device is completed by an abutment 54 mounted on the compaction arm 11 and limiting the rotation possibility of tie-rod 48 when subjected to a thrust exterted by tie-rod 46. A roller 55 is also mounted on the compaction arm and limits the rotation of tie-rod 46 about axis 47 when tie-rod 48 is bearing against abutment 54. Reference 56 designates an abutment provided on arm 11 in order to limit the rotation of tie-rod 48 in a direction away from abutment 54 for avoiding that the two articulation forming knuckle joints 45 and 47 reverse themselves and prevent the return of the device to its starting position under the action of jack 40. A hooking device carried by arm 35 and not shown connects, during the beginning of the return stroke, arm 35 to tie-rod 52 in order to ensure the return to the starting point of the tie-rod stepping down device.

Figure 9:
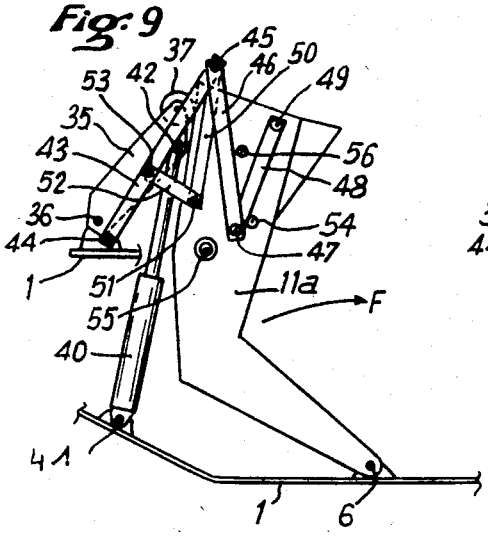
FIG. 9 is a side elevation view of a knuckle joint device associated with the coupling means with the lever and roller of FIG. 7, FIGS. 9 through 12 illustrate schematically, in four positions, said coupling and stepping down device.

In FIG. 9, the device is shown more clearly when jack 40 has already started its contraction stroke, the compaction arm having already slightly rotated in the direction of arrow F under the thrust exerted by roller 37. Axis 42 is inside the triangle circumscribed by tie-rods 43, 50 and 52 and the arm moves forward under only the thrust exerted by roller 37. After the rotation of arm 35 over an angle depending on the relative lengths of the tie-rods, axis 42 comes to bear against tie-rods 50 and 52 or inside the angle between said small tie-rods and from then on, controls, via tie-rod 50, the rotation of tie-rod 43 and of tie-rods 46 and 48. This coupling mode between axis 42 and the tie-rod system forms a dead stroke device allowing having first the arm with a roller acting successively while the thrust of the knuckle joints, the tie-rods of which form acute angles between themselves, is small, then the knuckle joint device in order to continue the compaction action with angles of the knuckle joints much more open.

Figure 10:
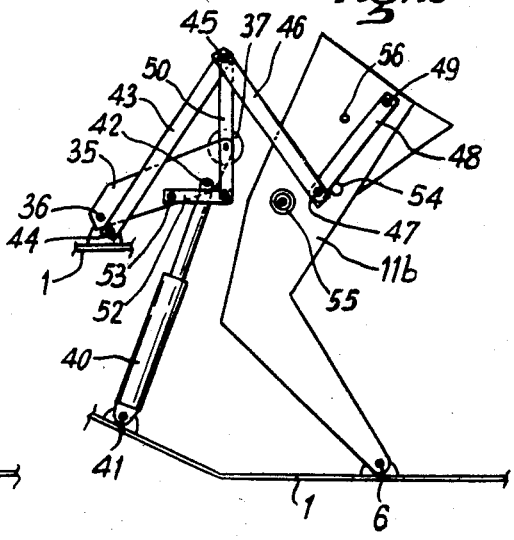
Figure 11:
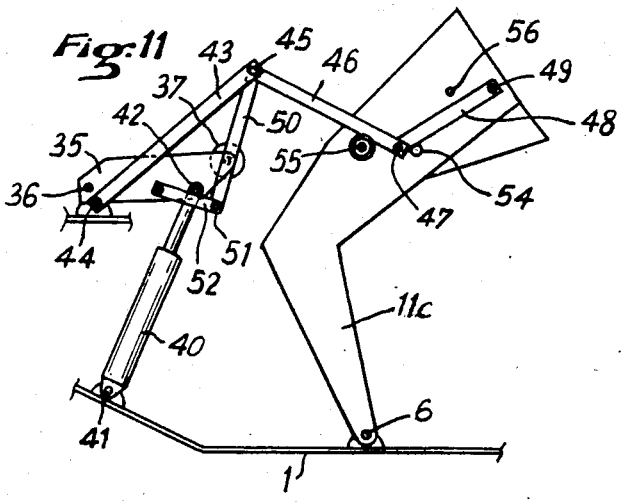
Figure 12:
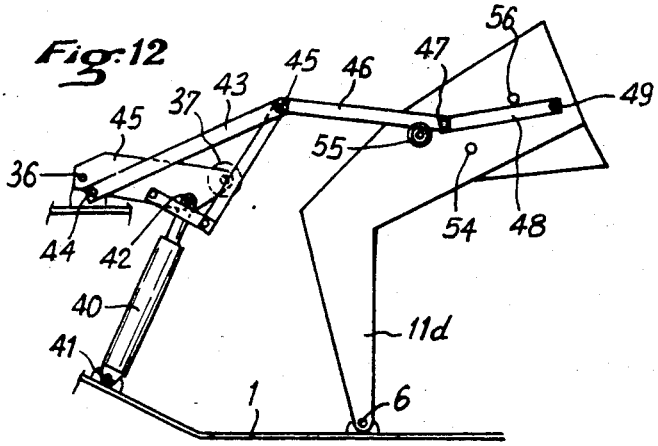
Figure 14:
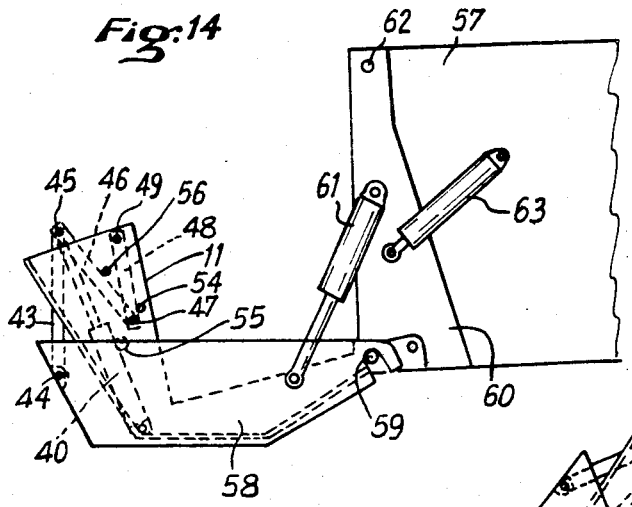
FIG. 14 is a side elevation view of a compaction device articulated at the rear of a parallelepipedal bucket.

In FIG. 10 is shown the device during this second stage, tie-rod 48 being pushed in engagement with abutment 54 and roller 57 being away from the rear face of the compaction arm. During this motion phase and due to the progressive opening of the angles of the knuckle joints 45 and 47, tie-rod 45 which rotates about axis 47 comes to bear against roller 55, as shown in FIG. 11. From that moment, the downward motion of axis 45 under the pulling action exerted by jack 40 transmitted by tie-rod 50 pivots tie-rod 56 about a roller 55 while simultaneously rotating tie-rod 48 about axis 49 and moving it away from abutment 54 in order to bring it closer to abutment 56. At that moment, tie-rods 43, 46 and 48 are almost in alignment and the pulling force exerted at point 45 is multiplied in a very important proportion.

Figure 13:
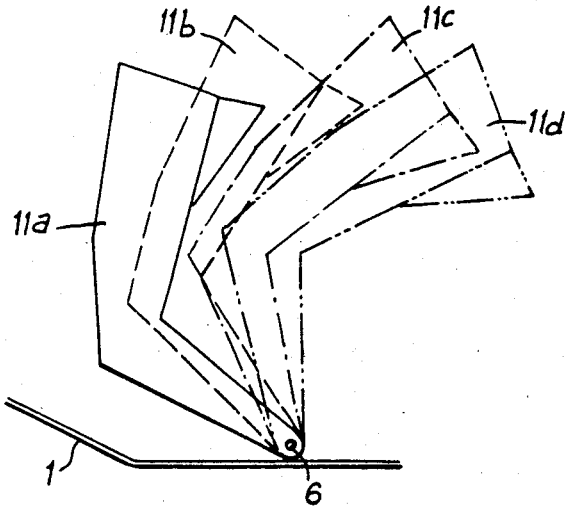
FIG. 13 is an explanatory diagram showing the various positions of the compaction arm in FIGS. 9 through 12.

Positions 11*a*, 11*b*, 11*c*, 11*d* of compaction arm 11 at the stages corresponding to FIGS. 9 through 12 are shown in FIG. 13.

In FIGS. 14 through 17 is shown a similar device adapted for the loading and compaction in a parallelepipedal bucket 57. In these Figures, the same references are used for designating the elements equivalent to those described with reference to FIGS. 9 through 12. In this embodiment, the arm with a roller 35–37 is not used and jack 40 acts directly on articulation 45. The three tie-rods 43, 46 and 48 articulated at 44, 45, 47 and 49 and the abutments 54, 56 as well as roller 55 carried by the compaction arm 11 are therefore present again, as in the previous embodiment. The compaction arm and its control device however are mounted in a caisson 58 articulated via a semi-circular opening and axis fitting 59 at the lower portion of a rear door frame 60, the axis 59 serving also as an articulation axis for the compaction arm 11.

Figure 15:
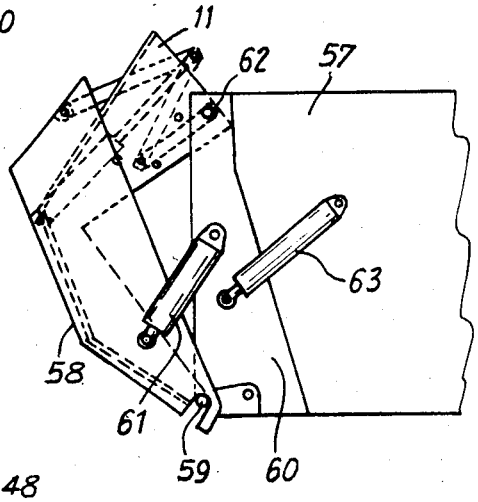
FIG. 15 is a view of the same device, during the loading of the bucket.
Figure 16:
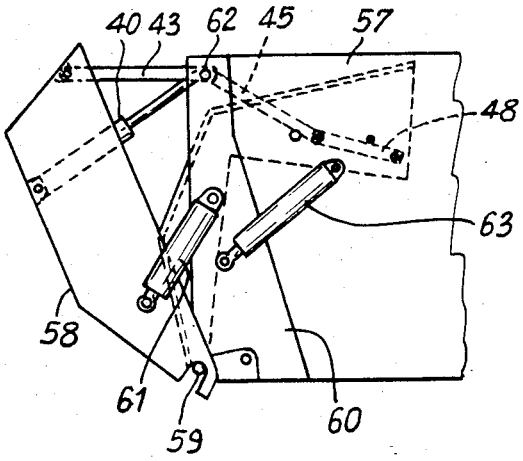
FIG. 16 is a view corresponding to FIG. 15 during the compaction stage of the load in the bucket.
Figure 17:
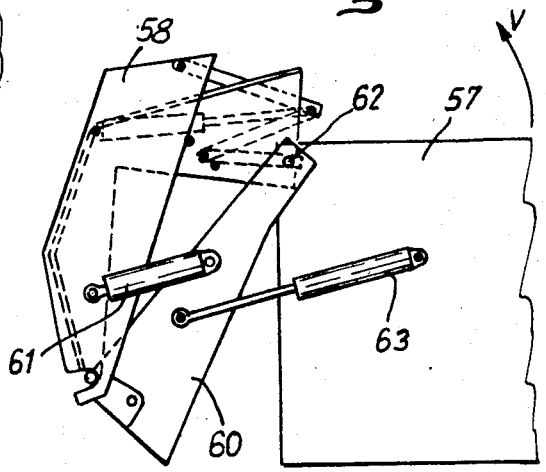
FIG. 17 shows the opening operation of the bucket rear part, prior to the unloading of said bucket.

Caisson 58 can be raised back by tipping about axis 59 under the action of a jack 61 in order to come in front of the rear opening of the bucket (FIG. 15). In this position, jack 40 can be set in action in order, during a first sequence, to move the products packed in the caisson, in the premilinary stage shown in FIG. 14, in bucket 57, then to compact the products which are in said bucket 57 as shown in FIG. 16. The rear wall frame 60 is preferably articulated at its upper end about an axis 62 and a jack 63 allows raising the rear wall frame 60 by rotating about axis 62, as shown in FIG. 17, in order to empty bucket 57 by inclining it by tipping in the direction shown by arrow V in FIG. 17.

The device shown in FIGS. 14 through 17 can be easily made removable from the bucket by removing a limited number of articulation axes or by disengaging the semi-circular opening from axis 59.

What is claimed is:

1. A bucket for compactable products, having a flat horizontal bottom and opposite upstanding side walls, a compaction member pivotally mounted on said bottom for vertical swinging movement about a horizontal axis disposed intermediate said side walls, said compaction member having a shape comprising a first portion that lies against the bottom of the bucket and a second portion that lies against one of said walls in a lowered position of the bucket, and means to move the compaction member from said lowered position to a raised position in which the compaction member compacts material in the bucket against a said side wall which is opposite said one side wall.

2. A bucket for compactable products according to claim 1, wherein the moving means comprises an arm articulated at one of its ends to the bucket about an axis parallel to the articulation axis of the compaction member and carrying at its other end a roller rotatably mounted about an axis parallel to said parallel axis and said articulation axis.

3. A bucket for compactable products according to claim 2, wherein the point of action for the moving means on said arm is situated above the point of articulation of said arm on the bucket and between said articulation axis on the bucket and the rotation axis of said roller.

4. A bucket for compactable products according to claim 1, wherein the moving means comprises a knuckle joint device, two tie-rods on either side of the knuckle joint being articulated on a point of the compaction member on the one hand, and on a point fixed with respect to the bucket on the other hand, and means acting on the knuckle joint in order to draw apart the two points of articulation by bringing the knuckle joint nearer an imaginary line joining said two points.

* * * * *